US006431969B1

(12) United States Patent
Sauter et al.

(10) Patent No.: US 6,431,969 B1
(45) Date of Patent: Aug. 13, 2002

(54) DEVICE FOR GRINDING OF CARD CLOTHINGS

(75) Inventors: Christian Sauter, Flurlingen; Beat Bühler, Winterthur, both of (CH)

(73) Assignee: Maschinenfabrik Rieter AG, Winterthur (CH)

( * ) Notice: Subject to any disclaimer, the term of this patent is extended or adjusted under 35 U.S.C. 154(b) by 0 days.

(21) Appl. No.: 09/509,756

(22) PCT Filed: Sep. 23, 1998

(86) PCT No.: PCT/IB98/01471

§ 371 (c)(1),
(2), (4) Date: Aug. 21, 2000

(87) PCT Pub. No.: WO99/16579

PCT Pub. Date: Apr. 8, 1999

(30) Foreign Application Priority Data

Oct. 1, 1997 (CH) ..... 2302/27

(51) Int. Cl.[7] ..... B24B 19/00
(52) U.S. Cl. ..... 451/416; 451/417; 451/184
(58) Field of Search ..... 451/416, 417, 451/424, 184; 19/98

(56) References Cited

U.S. PATENT DOCUMENTS 3,528,205 A * 9/1970 Roberts ..... 51/243
4,227,285 A 10/1980 Hamrick
5,277,000 A 1/1994 Demuth et al.
5,355,560 A * 10/1994 Fritzsche et al. ..... 19/98
5,797,788 A * 8/1998 Graf et al. ..... 451/28
5,989,110 A * 11/1999 Leifeld ..... 451/416
6,129,614 A 10/2000 Faas et al.

FOREIGN PATENT DOCUMENTS

| | | | |
|---|---|---|---|
| DE | 4115960 | A | 11/1992 |
| EP | 340458 | A1 | 4/1989 |
| EP | 565486 | A1 | 3/1993 |
| EP | 787841 | A1 | 8/1997 |
| EP | 800895 | A1 | 10/1997 |
| JP | 63295169 | | 12/1988 |

OTHER PUBLICATIONS

PCT Search Report dated Dec. 17, 1998 for PCT/IB/98/01471.
U.S. application No. 09/786,731, filed Mar. 8, 2000, Co–pending.

* cited by examiner

*Primary Examiner*—Timothy V. Eley
*Assistant Examiner*—Dung Van Nguyen
(74) *Attorney, Agent, or Firm*—Dority & Manning

(57) ABSTRACT

A grinding device for the flats of a card comprises elastically bendable elements which enter between the card clothing points, brush across the lateral surface of the points and thus grind them, whereat the material that has been ground off is removed by a suction means. The grinding device may be portable so as to be used on different card machines. A control system may be provided to engage and operate the device in an interrmitten manner.

16 Claims, 5 Drawing Sheets

DEVICE FOR GRINDING OF CARD CLOTHINGS

FIELD OF THE INVENTION

The invention relates to the grinding (or "sharpening") of card clothings, in particular but not exclusively of card clothings of flats for a revolving flat card. The invention is suitable for the installation of a grinding device (sharpening device) in the card, but is not limited to this way of application and could, therefore, be applied in a device which, if required, can be attached to a card and which can be carried from one card to another card. However, this also sets no limit, the invention could also be applied in a device which is only engaged during the non-operative (not producing) period of a card.

The invention relates to the grinding (or 'sharpening') of card clothings, in particular but not exclusively of card clothings of flats for a revolving flat card. The invention is suitable for the installation of a grinding device (sharpening device) in the card, but is not limited to this way of application and could, therefore, be applied in a device which, if required, can be attached to a card and which can be carried from one card to another card. However, this also sets no limit, the invention could also be applied in a device which is only engaged during the non-operative (not producing) period of a card.

RELATED APPLICATIONS

EP-A-800 895 (corresponds to U.S. Pat. No. 6,129,614) describes a sharpening or grinding device which can be used for grinding of card clothings of flats. With the present invention the concepts of the earlier application are further improved.

According to the earlier application (the earlier invention, respectively) a grinding device comprises a number of single grinding elements, which enter between the points of the card clothing to be ground, thereby brushing across the head portions of the points and thus grinding them. The grinding elements are preferably elastic and bendable.

The grinding elements can be arranged in such a way that during operation they are distributed across the operating width of the card. For this purpose they can be carried by an oblong support, for instance in such a way that each grinding element on one of its ends is fastened onto the support and from where it protrudes laterally. During operation the support can be mounted on the card frame by means of a holder in an approximately predetermined relation to the revolving flat unit, for instance in such a way that the flats are being ground during their 'return motion'.

Together, the grinding elements, the support and the holder can form a device which is installed within the card, for instance in such a way that the device is put into operation with the card itself. For this the card can comprise a drive or control means for the grinding device. However, the device can be laid out in such a way that it can be mounted onto the card, it could for instance comprise an own drive or an own control means.

SUMMARY

The present invention

According to a first aspect of the present invention a grinding device for card flats, in particular a grinding device according to the earlier invention, is further being characterized, in that it is being provided with a means (preferably a suction means) to remove grinding particles that develop during grinding.

According to a second aspect of the present invention a grinding device according to the previous invention or a device according to the first aspect of the present invention is being further characterised, in that it is arranged in such a way in relation to the card clothing support (for instance a revolving flat unit) in that basically a predetermined engagement depth of the grinding elements into the card clothing results.

The predetermined engagement depth preferably results by presenting of the card clothing support (a flat rod) to the grinding unit, whereat the presenting of the device to the card clothing support is not excluded. For this purpose a controllable presenting device can be furnished.

The arrangement can be chosen in such a way that a change of the engagement depth due to wear of the grinding element can at least partially be compensated, for instance by an appropriate adjustment of the presenting movement.

According to a third aspect of the present invention a grinding device according to the previous invention or according to the first and/or second aspect of the present invention is being further characterised, in that it is being put into a non continuous but controlled discontinuous (intermittent) operation, whereat the expected (effective) operating period can represent less than 5% (possible less than 1%) of the working life of the card.

Exemplified embodiments of the invention are being described hereafter in detail according to the figures of the drawing.

Additional objects and advantages of the invention will be set forth in part in the following description, or may be obvious from the description, or may be learned through practice of the invention.

BRIEF DESCRIPTION OF THE DRAWINGS

The drawing show

It is preferable if the grinding or sharpening device can be applied as a portable maintenance device for card clothings of different machines. In particular because of the relatively short engagement time of the device it is more economical to have a single device for several machines.

DETAILED DESCRIPTION

Figure 1:
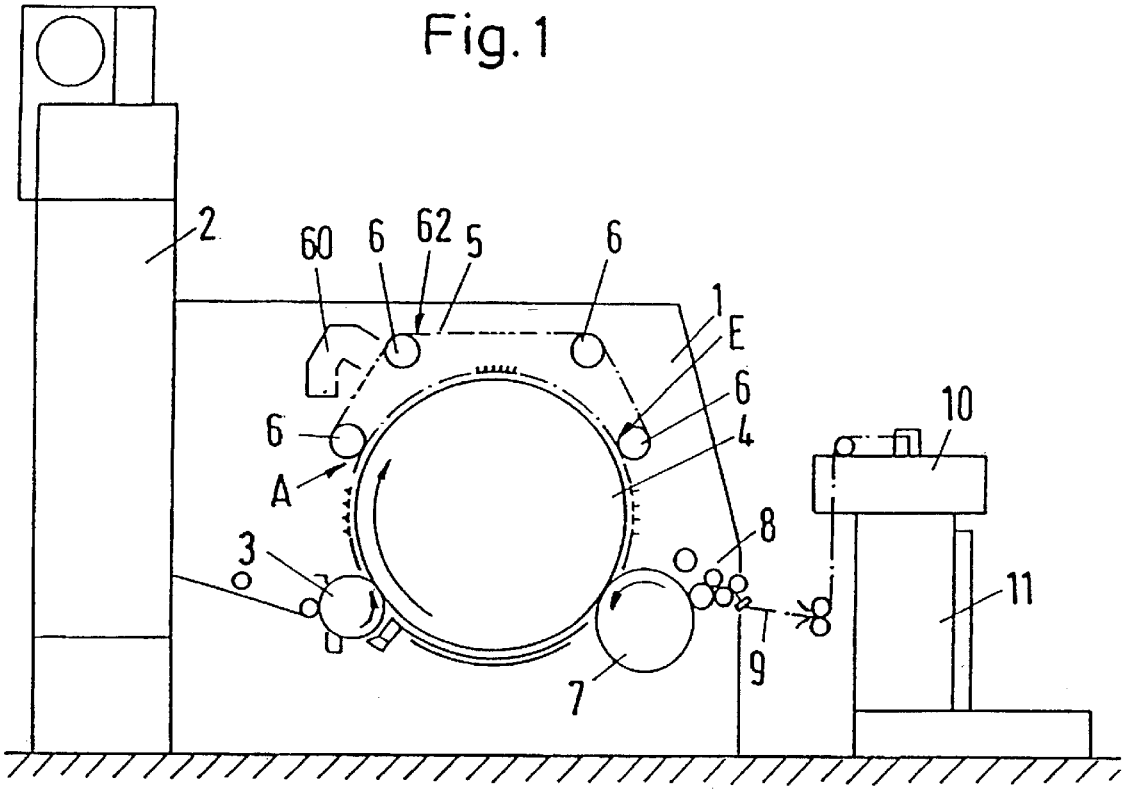
FIG. 1 a copy out of FIG. 1 of EP-A-787 841.

FIG. 1 schematically show a known revolving flat card 1, for instance the card C50 produced by Maschinenfabrik Rieter AG. The fibre material is being fed into the feeding chute 2 in the form of lose and cleaned flocks, then it is being received as cotton lap by a licker-in or taker-in device 3, furthermore it is being transferred to a cylinder or drum 4 and loosened and cleaned by a revolving flat unit. Fibres from the fibre web being formed on the cylinder 4 are then received by a doffer 7 and being transformed into a sliver 9 within an outlet arrangement 8 comprising various rollers. This card sliver 9 is then, by means of a can coiler 10, being deposited into a can 11 for transportation. The card is being provided with a "main suction means" by which waste can be removed. Such a suction means is not specifically shown in FIG. 1, since such a device is well known to those skilled in the art. An example of such a suction means can be found in EP-A-340 458. The revolving flat unit comprises the revolving flat rods, which are not indicated with the reference numerals 14 in FIG. 2. Each rod is being furnished with a card clothing 14.

The flats 13 are fastened onto a chain or belt 5 (for instance according to EP-A-753 610) and they are thus moved within a closed 'flat path' (via deviating rollers 6) in the opposite direction or in the same direction of the turning direction along the cylinder 4, whereat on a 'forward path' (from the inlet point E to the outlet point A) the carding work is being performed and on the 'return path' the flats are being cleaned at a cleaning station 60. The cleaning unit has been explained in more detail in the earlier application. After cleaning, for instance at the position 62 the flats 13 can be ground according to the earlier application.

Figure 2:
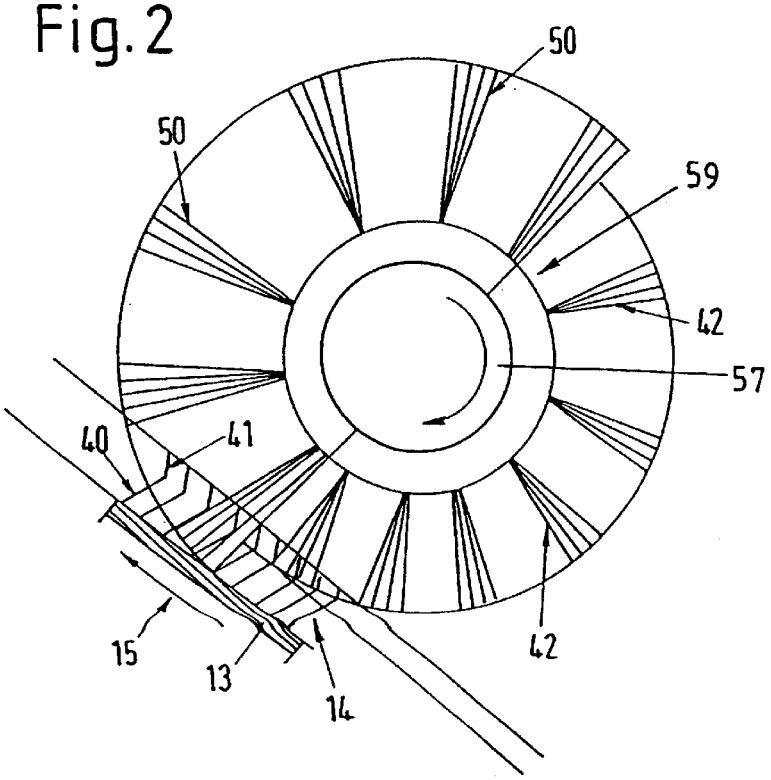
FIG. 2 a first embodiment of the previous invention.

FIG. 2 shows an embodiment according to the earlier invention, whereat in this embodiment the grinding and the cleansing position "coincide." This embodiment comprises a "brush" with a sleeve 59 (FIG. 2), grinding elements 42 and cleaning bristles 50, which are being carried by the sleeve and which extend in radial direction away from the sleeve 59. The sleeve 59 preferably consists of two "halves" which, when mounted, rest smoothly on the drive shaft 57. The brush is considered to be part of the flat cleaning device 60. FIG. 2 also shows a flat rod 13 (inclusive of card clothing 14). The moving direction of the flat rod 13 and the turning direction of the sleeve 59 are indicated by arrows.

As is customary for the trimming of card flats the card clothing 14 is furnished as a flexible or semi-rigid card clothing, whereat the single card clothing elements 40 are made of wire (flat or round wire), each formed with a so called knee 41. The bristles 50 reach down to the bottom of the card clothing 14, that is down to the surface of the rod 13 from which the wires 40 protrude in order to thoroughly clean the card clothing. However, only half the circumference of the sleeves 59 is being furnished with bristles 50, the other half carries the previously mentioned grinding elements 42.

Figure 3:
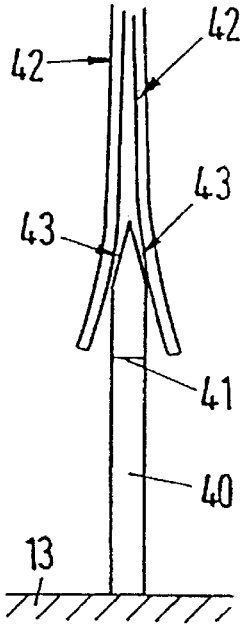
FIG. 3 a schematic illustration of a single wire, seen in front view, to show the grinding effectiveness according to the earlier invention, FIG. 4 a schematic illustration of the same piece of wire seen in side view, FIG. 5 a schematic illustration of a variant of the embodiment according to FIG. 2, also according to the earlier invention, whereby

The form of the grinding elements 42 is similar to the bristles 50 at least in that they consist of oblong, elastically bendable elements, which protrude more or less radially away from the outer surface of the sleeve 59. The grinding elements 42 are also more flexible than the wires 40, so that in case of contact, such an element with a wire part during the relative movement of the element and the wire, the grinding element 42 has to give way. The elements 42, however, are clearly shorter than the bristles 50, so that they only reach the 'head portions' of the card clothing wires 40 (beyond the respective knee 41). The velocity of the free end zone of each element 42 is still higher than the velocity of the card clothing wires 40 in the moving direction 15. While the grinding elements 42 are moved past the card clothing elements 40, they therefore enter the card clothing, whereat at their free end parts on both sides of the head parts of the wires the grinding elements are being deviated (FIG. 3).

Figure 4:
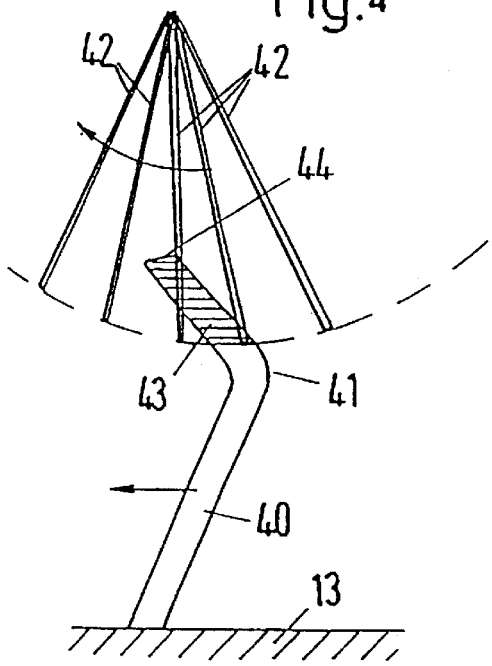

The head parts of each wire element are being provided with a laterally ground portion, that means the side surfaces 43 (FIGS. 3 and 4) converge outward in radial direction in order to form a head edge 44. At each passage of the grinding elements 42 on the surfaces 43 a polishing or grinding action on the surface 43 takes place. The aggressivity of the polishing or grinding effect depends on the layout of the grinding elements and the velocity of the relative movement. The optimal effect of a given type of wire can be determined empirically.

The solution according to FIG. 2 has certain advantages for retrofitting of existing cards, which are provided with a cleaning brush (only with bristles 50). The 'infrastructure' (that is the support in form of a sleeve 59, its support in form of the shaft 57 and its bearing and the pertaining drive) are already present. The flat cleaning means, however, is continuously in operation (as long as the card is running), therefore the flat wires are ground 'continuously' and certain disadvantages have to be taken into account.

The cleaning effect declines, since half of the cleaning bristles 50 'are missing' (because they have been replaced by grinding elements), it is not possible to set the speed of the shaft 57 (FIG. 2) in a way to obtain the optimal cleaning as well as grinding effect, it is not possible to separately 'switch off' the grinding, for instance to perform periodical grinding (according to a controlled 'stop/go' procedure). Such a process is for instance described in EP-A-565 486.

It was therefore found to be of advantage to provide an individual infrastructure in the card for the grinding, in particular a separate holder for the support (onto which the grinding elements 42 are being fastened) and a separate controllable drive. Thus a relative velocity of the grinding elements in relation to the wires of more than 15 m/sec (for instance of 20 m/sec) can be achieved. For a cleaning brush such a relative velocity is not optimal. Thus the grinding place is being separated from the cleaning place and is preferably located behind the cleaning position, seen in the moving direction 15 (FIG. 2).

Figure 5:
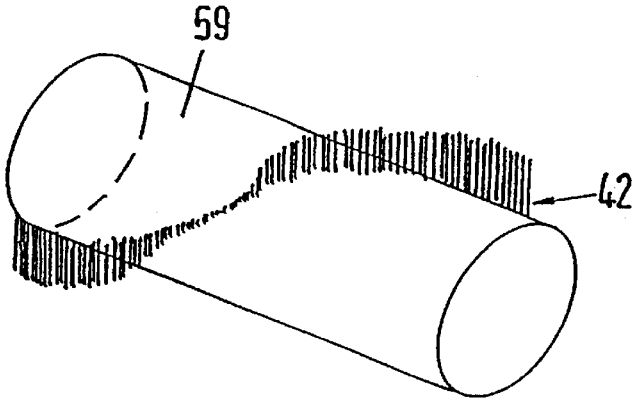
FIG. 5A shows a detail of said embodiment, FIG. 6 a schematic illustration of a preferred arrangement of the grinding bristles on their support, FIG. 7 a schematic side view in a cross section of a preferred device, FIG. 8 a detail from FIG. 7, FIG. 9 a schemata of a flat presenting device of the device according to FIG. 8 and FIG. 9A a time diagram to explain the schemata according to FIG. 9.

The embodiment according to FIG. 5 comprises a helix-shaped arrangement of grinding elements 42 along a cylindric support. Each element is furnished as one bristle 45 (see in particular detail—FIG. 5A). The bristles 45 are shorter than the bristles 50 of the embodiment according to FIG. 2 and at least the free end section of each bristle 45 is being provided with a grinding means in order to form a grinding zone (grinding body). The entire bristle can for instance be interspersed with grinding means. The grinding means consists for instance of hard particles 46 (grinding grains, diamond grains or similar), which are being fastened to the bristle 45 by means of an adhesive or a bonding material or which are embedded into a matrix. The helix-shaped row of the elements 42 extends over the whole length of the support and thus over the whole operating width. On the side of the sleeve 59, not being visible in FIG. 5, a second row of grinding elements can be arranged in mirror-inverted fashion in relation to the first row.

The foregoing description was based on the assumption that the grinding device is to be mounted within the card. The earlier invention however, is not limited to this way of application. The card could for instance merely be provided with mounting points, whereat a holder of the grinding device could be attached. The device itself could then be carried from one card to another card and only be mounted onto a respective card if required and then be put in operation. Such a device could be provided with a separate drive in order to rotate the support which carries the grinding elements or it could merely be provided with a coupling in order to allow a temporary connection with the drive of the machine.

The preferred solution according to the earlier invention was furnished with a grinding device including its own 'infrastructure' (support, drive, etc.) and with grinding elements according to FIG. 5, whereat the support 59 preferably was fully 'covered' (instead of only being provided with single helix-shaped rows of grinding elements), that is in a way, that practically the entire circumference should be occupied with grinding elements. Trial tests of this embodiment have now led to certain improvements.

Figure 5A:
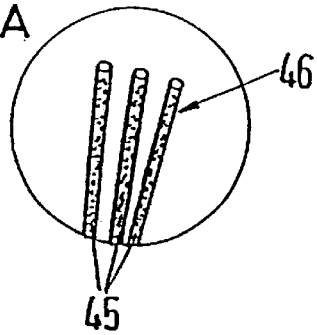
Figure 6:
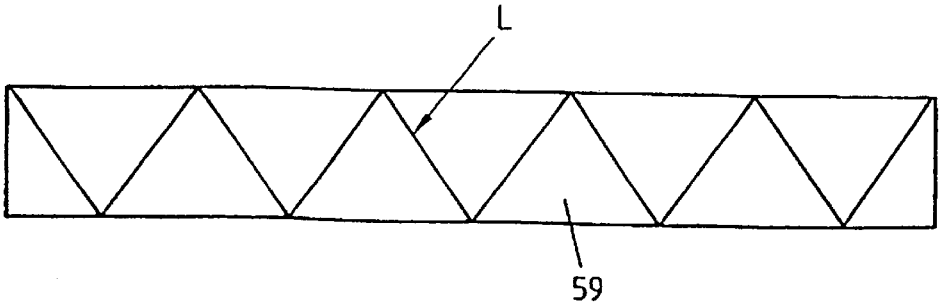

Contrary to the opinion stated in the earlier invention it proved not to be desirable to furnish the brush as a 'fully covered' support. Grinding elements are available commercially which are effectively too aggressive in case of a fully covered layout. The preferred arrangement is therefore shown in FIG. 6 and consists of a zigzag-shaped row of the bristle groups along each sleeve half. The single bristles are shown in FIG. 5A—each consists of a filament-type nylon substrate interspersed with siliciumcarbide. With the successive abrasion of the bristles new grinding particles appear on the grinding surface. From the number of 'bristle lines' L results the number of card clothing points which are being ground at the same time. This can be chosen in dependence of the output performance of the drive.

Figure 7:
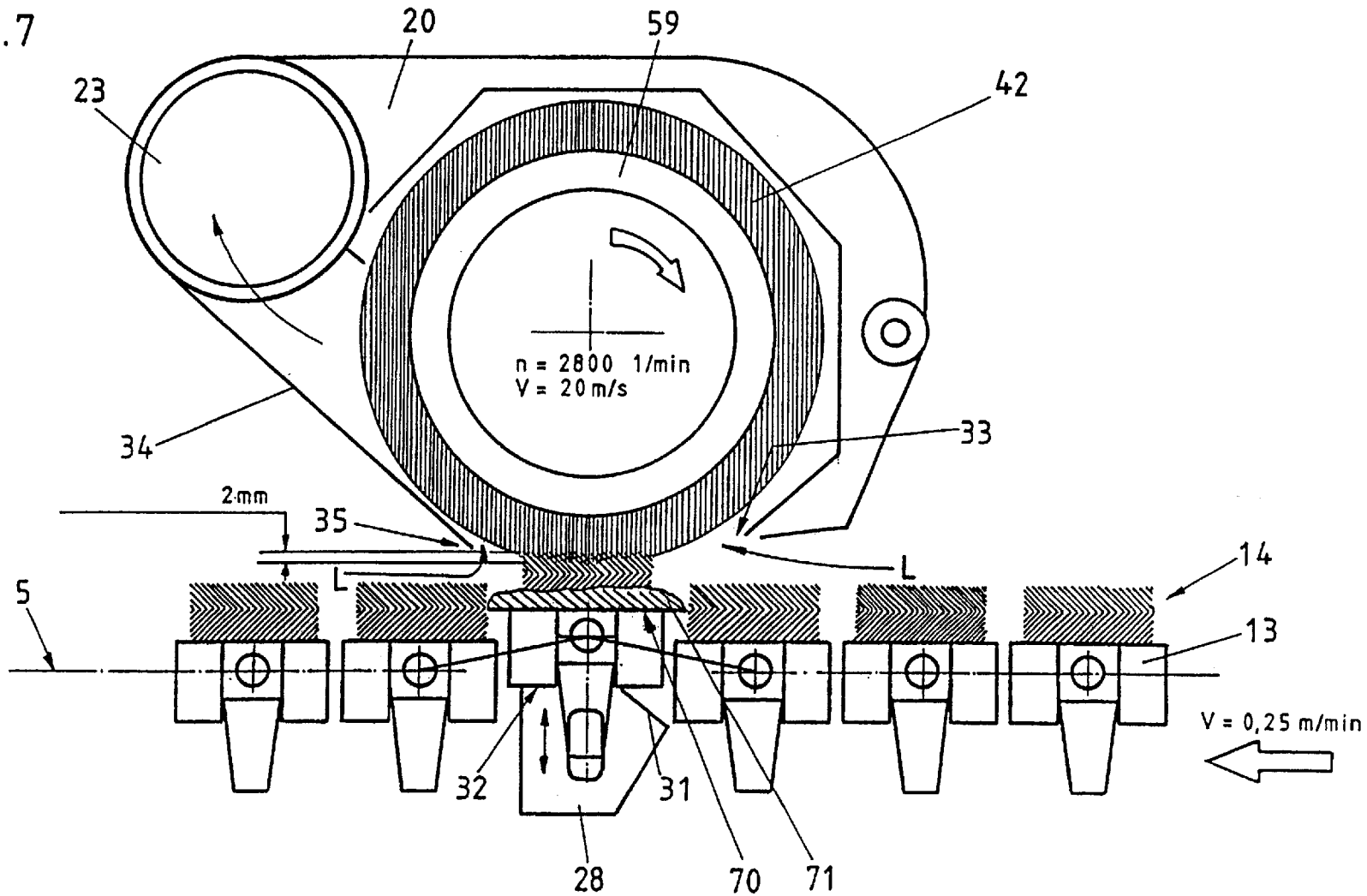

FIG. 7 shows two further modifications of the arrangement according to the earlier invention, that is:

a suction means for the removal of grinding particles and a flat presenting device which can present the flat rods one after the other for grinding of the respective card clothing by lifting it out of the path of the flats into a grinding position of the brush.

The sharpening or grinding device according to FIG. 7 therefore comprises the following elements:

- a casing 20, which serves for the mounting onto the card frame at a predetermined position outside of the flat path and in downstream direction from the cleaning position 60 (FIG. 1)
- the brush with the support 59 (preferably formed from sleeve halves), grinding bristles 42 and a respective bearing or holder (not shown) within the casing 20.
- a controllable brush drive 22 (FIG. 9), which is fastened to the casing 20 and which by means of a coupling 21 is connected to a shaft 57,
- an air suction channel 23 which extends across the operating width of the card clothing and which at one end by means of a coupling 24 can be connected with the main suction means 25 of the card,
- a pneumatically operable shifting device 26 (FIG. 9) which is being arranged on the inner side of the path of the flats and which is being located opposite the casing 20 of the grinding device.

The shifting device 26 comprises two lifting elements 28, which are arranged each near a side shield (not shown of the card). These elements are movable vertically up and down between a lower starting or resting position and an operating position by means of one pneumatic cylinder 29 each and lever 30. Each lifting element 28 is being provided with a ramp 31 and a horizontal support surface 32.

The card itself comprises an air pressure supply 27 for the shifting device 26 and a control means (not shown) for the brush drive 22.

The new grinding device operates as follows:

After the card with a new card clothing has been put into operation, the grinding device does not yet work, that means neither the brush nor the shifting device are being energised by the card. The flats 13 therefore travel along their 'normal path', without contacting the lifting elements 28 of the shifting device 26, since these elements at that time remain in their lower (starting) positions. The position of the casing 20 in relation to the normal path of the flat is also chosen in such a way that there is no contact between the grinding bristles 42 and the card clothing points. By means of a flap (not shown) the suction channel 23 is shut toward the main suction means 25 of the card, so that no air flow is being generated in the suction channel 23 through the casing 20.

Figure 8:
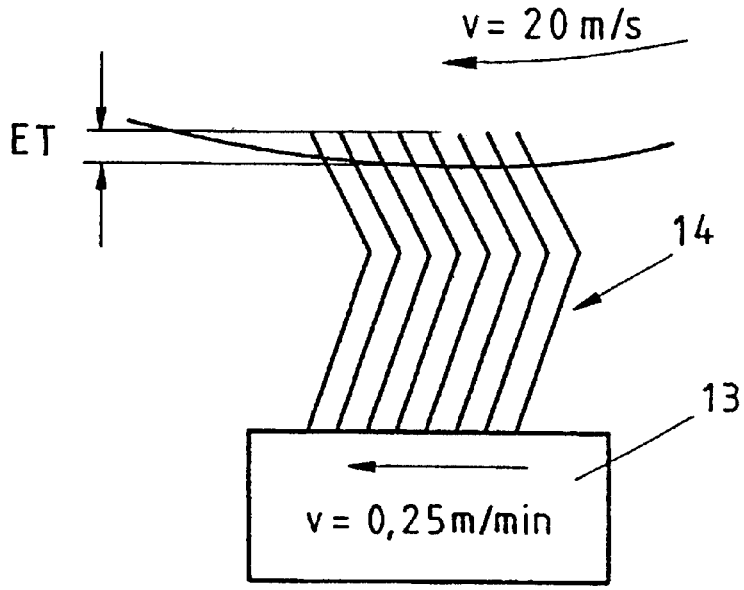

At a suitable point of time (which is explained in more detail in the following) the grinding device (together with the shifting device and suction means) is being put into operation. For this the brush is being put into rotation in the direction of the arrow (FIG. 7), the air suction channel 23 is being connected to the main suction means 25 of the card and the pneumatic cylinders 29 are being actuated, so that the lifting elements 28 are lifted into their operating position. As shown schematically in FIG. 7, the flats 13 cannot pass the lifting elements 28 without contacting the ramp 31. While the flats 13 are being pulled forward by the chains or belts 5, one after the other is being forced to climb up the ramp 31, then move parallel to the normal path over the support surface 32 and then return to the normal path. When the lifting elements 28 are in their lifted (operating) position, the support surface 32 defines a 'grinding position', whereat the points of the wires of the card clothing 14 are positioned within the cylindrical circumferential surface of the grinding bristles 42. The stroke of the lifting movement is chosen in such a way, that the grinding bristles 42 (while a flat 13 is being presented to the brush by the shifting device 26) enter the card clothing downwards to a predetermined 'insertion depth' ET (FIG. 8) and thereby grinding the card clothing points (according to the earlier invention). For a semi-rigid or flexible card it has proved to be advisable to provide for a maximum insertion depth ET of approximately 2 mm (measured from the card clothing point, (compare FIG. 8), whereat this parameter can be optimised in dependence of the card clothing type and in particular can be chosen differently for an all-steel card clothing.

The shifting device 26 remains in this operating position until each flat 13 has been ground 'xtimes', where 'x' can be any rational number, preferably in the range from 1 to 5. The lifting elements 28 are then lowered again. A suitable control procedure is being explained in more detail in the following. In the following, the grinding of all flats 'x-times' is called a 'grinding cycle'.

Preferably the lifting elements 28 press the flats 13 at each end of the flats 13 against a stopping surface 70 of a stopping device 71. The stopping surface 70 is positioned at a predetermined distance from the grinding elements 42. By means of this stopping surface the entering depth of the grinding elements 42 into the card clothing 14 is being determined. Since the height of the card clothing gets less with each grinding cycle, and since the entering depth requires a certain depth for an optimal grinding, it is particularly preferable if the stopping surface 70 is adjustable in relation to the grinding elements 42. For a card clothing 14 that has already been ground several times, thus the distance from the stopping surface 70 to the grinding elements 42 is less than in comparison to a new card clothing 14. The shifting elements 28 press the flat 13 only as strongly against the stopping surface 70 so as to cause a clamping effect which is so low that an advancing movement of the flats 13 over the shifting elements 28 can take place.

Grinding can take place without switching off of the card. For this it is, however, of advantage if the grinding device operates on cleaned flats 13, that is the grinding device is mounted in the path behind the flat cleaning. It has also proved advantageous to remove the particles which develop during the grinding, since they can otherwise deposit themselves on the running surfaces of the flats 13 (on the 'gliding arch' of the card, not shown). The removal of the waste material is accomplished by means of an air flow L which is generated by sub-pressure within the suction channel 23 and which preferably is flowing through the flat grinding arrangement from one side to the other. For this the casing 20 is provided with a suitable air-intake opening 33. A casing cover 34 extends from the suction channel 23 nearly up to the grinding position of the flats, i.e. as close as possible, without risking a brushing contact of the grinding bristles with the free edge 35 of the casing cover wall 34.

After the card clothing points have been ground, the device is switched off again in that the power supply to the shifting device 26 and the brush drive 22 is stopped and in that the connection of the suction channel 23 to the main suction means 25 is closed again by the flap (not shown). Accordingly the flats 13 merely move along the normal path of the flats and they are not any longer presented to the grinding brush. After an operating period without grinding of the flats, the grinding device can be set into operation again in order to keep the carding work quality in the main carding zone at the desired level.

After a few grinding cycles have been performed, the grinding bristles 42 will be shorter in relation to their initial length due to wear. Even though the bristles 42 themselves are still usable, the required minimum entering depth ET (at unchanged flat presenting movement) cannot be reached any longer. This problem may principally be solved in that the casing 20 is being adjusted in relation to the card frame. In the preferred embodiment, however, the presenting movement is changed in order to compensate the shortening of the bristles 42. This can be achieved in that a stopper (not shown) is being provided in order to determine the (lifted) positions of the lifting elements 28 when presenting the flats 13, whereat the position of the stopper is adjustable in relation to the brush. The pneumatic shifting device 26 has to be laid out in such a way that it can lift the lifting elements 28 up to a given 'limiting position' of the stopping element. As soon as this position is reached the shortening of the grinding bristles 42 has progressed so far that it is more useful to replace them rather than use them further.

The grinding device can be operated manually in such a manner, that it can be put into operation and taken out of operation by hand, for instance with start/stop push buttons on a control panel which is being arranged directly to the device. An operator can thus decide when and for how long the device is to be put into operation. In a more efficient embodiment, however, the device is specifically controlled, preferably by the card control means, for instance according to an operating concept which is generally described in EP-B-565 486. In the preferred embodiment the card clothings of the flats are being ground after processing of a predetermined quantity of fibres (for instance tons), whereby the predetermined quantity can vary depending on the type of fibre.

Figure 9A:
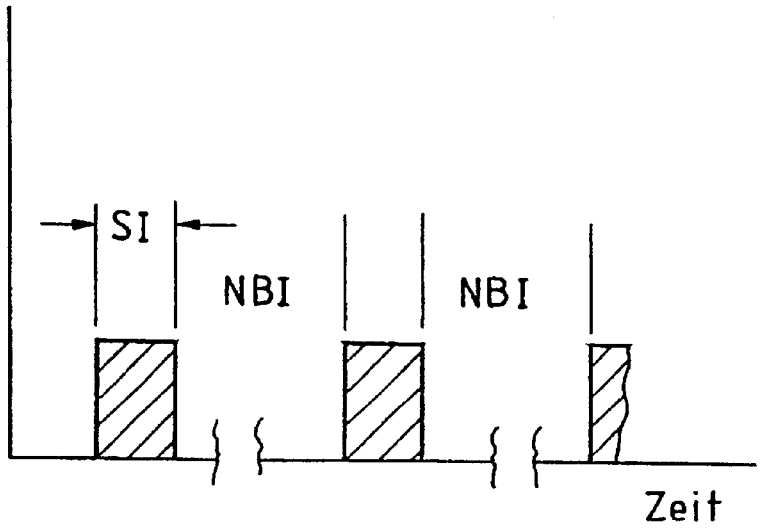
Figure 9:
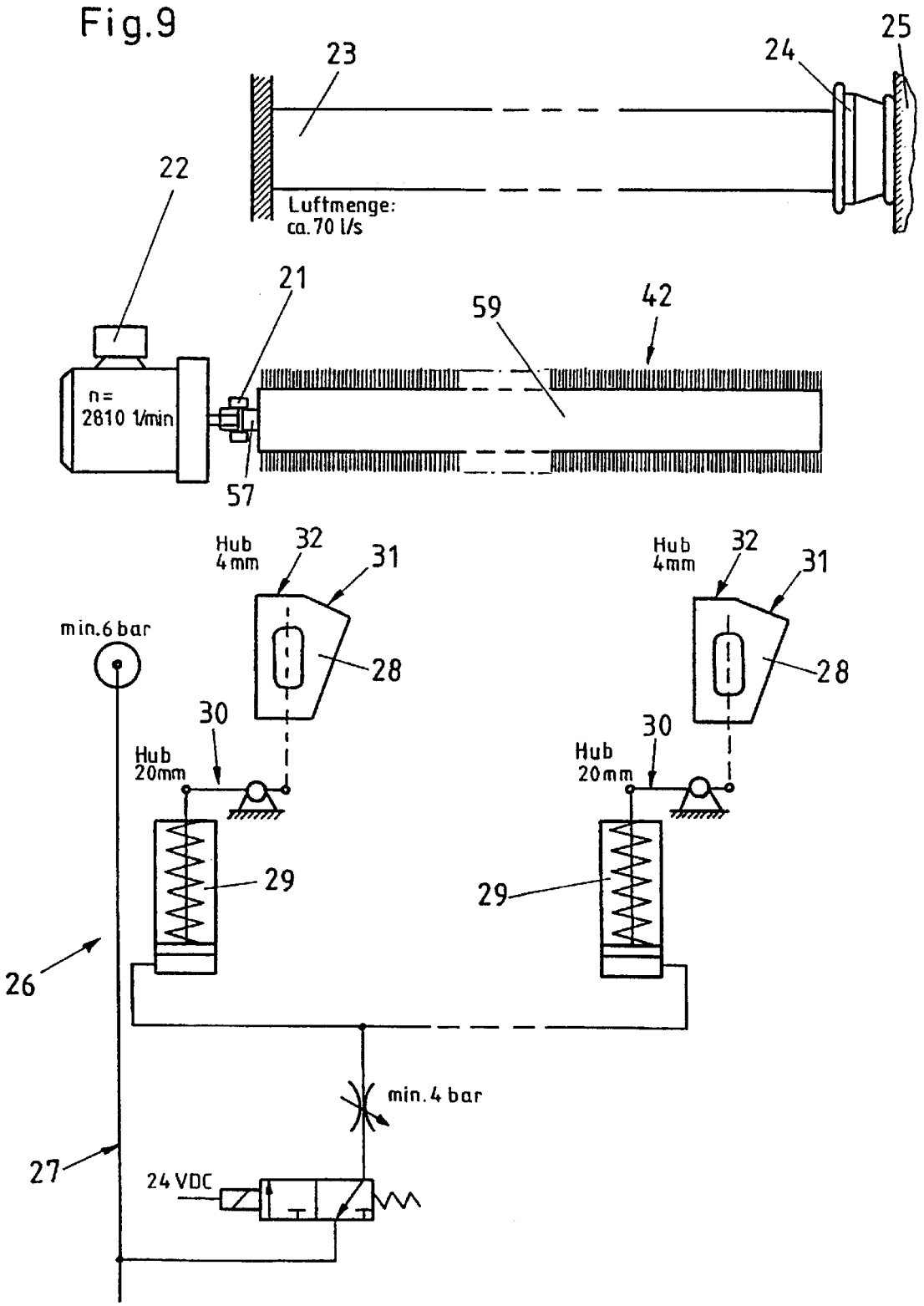

Thus preferably an 'operating program' results for the lifting device as shown schematically in FIG. 9A. Accordingly there is a normal operating period NBI followed by a grinding period SI, which again is followed by a normal operating period NBI. During the normal operating period the grinding device is not engaged—it is only supplied with power during a grinding period, that means that during a grinding period one grinding cycle has to be carried out.

The diagram in FIG. 9A cannot show the time relations realistically, therefore 'break lines' are indicated in the normal operating period. A normal operating period NBI will be much longer than a grinding period SI. If, for instance for simplification it is assumed, a set of flats comprises one hundred flats which are moved along the path of flats at a velocity of approximately 250 mm/min, with a pitch of the flats measuring approximately 40 mm, one grinding period i.e. one grinding cycle will for instance last approximately 4000/250 minutes=approximately 16 minutes.

The grinding period can be time-controlled, that is the shifting device 26 can be operated for a predetermined period of time to keep the lifting element 28 in its operating position, whereafter it can be lowered again into its starting position. In the preferred embodiment however a flats sensor (not shown) is being provided at the grinding position which counts the passing flats 13, so that the lifting elements 28 remain in operating positions until all flats have passed the grinding position once (or x-times).

The preceding description of the present invention again assumes that the device is being mounted within the card, which, however, is not relevant to the invention. The grinding device can be laid out as a maintenance device, which is mounted onto a specific card for grinding, but afterwards it is being carried to another card. Such a device should also be equipped with a suction means, which, however can not necessarily be coupled with the main suction means of the card, because there are various types of cards and the device should be applicable as 'universally' as possible. A 'portable' device, however, could be connected with its own sub-pressure source by which the grinding dust can be removed.

A portable device may comprise a flat presenting or flat lifting device. However, this is not absolutely necessary for such a device. Firstly it is customary that card manufacturers provide flat lifting devices and even mount them into the card in order to allow grinding of the flats with a conventional grinding roller and secondly it is quite possible, when mounting a portable device, to then determine the entering depth with the adjusting means of the holder for said device, that is without having to present the flats to the brushes at all. It will also be clear that a portable device is more suitable for manual operation, even though time-controller or flat counter could be used without any problems for the controlling purpose of the grinding cycle.

A portable device could be designed to be engaged in running cards, it will, however, normally be applied in cards that are in a non-producing state. In the latter case it is not absolutely necessary to mount the grinding device at a certain relation to the flat cleaning means, since the flats are being cleaned in any case during 'servicing', that is independent of the card cleaning device.

The maximum entering depth ET of approximately 2 mm can for instance also be reduced to approximately 1 mm, before the presenting movement is being changed, whereby it is not preferable to go below an entering depth of 1.5 mm. The change of the presenting movement (in the example given, the change of the position of the adjustable stopping device) is preferably also controlled, whereby principally it can also be performed manually.

The grinding or sharpening procedure can be carried out without coolant (dry sharpening) that is for flexible, semi-rigid and all-steel card clothings.

The length of the sharpening bristles at first use can be 15 to 20 mm. The graining of the bristle can amount to approximately between 300 and 600, for instance approximately 500. The flap (not shown) which separates the suction channel 27 from the main suction means can be operated by the flat presenting device (the shifting device 26).

A suitable protection for the running surfaces (the gliding arch) of the flats can be provided in order to prevent deposits of grinding dust thereon. Respective covers are not shown since suitable elements for the application with conventional grinding rollers are known and can, therefore also be applied in combination with the new device.

The aggressivity of the grinding element i.e. the grinding device may have to be increased for the treatment of an all-steel card clothings, which again might put forward the 'fully trimmed' (fully spiked) carrier. Since the 'side grinding' is of no relevance to the all-steel card clothing, the elements can be altered so that they mainly act upon the (radially outward directed) front sides of the card clothing teeth. For this the elasticity or the shape (for instance the width) of the grinding elements may be changed in such a way that there is less tendency for them to enter between the card clothing elements, but to have more capability to bend along the moving direction of the card clothing elements. Instead of grinding bristles one could for instance choose lamella which 'support' themselves on the end face of the card clothing teeth. Such a grinding device could also be applied for grinding of cylinders, licker-in or doffer clothings.

According to this aspect of the invention, therefore, a grinding device is being provided which is equipped with elastically bendable grinding elements, whereat said elements brush across the front end sides of card clothing elements and thus effect them to be ground or sharpened.

We claim:

1. A grinding apparatus for grinding individual clothing elements of a set of moving flats in a textile machine, the clothing elements having a head portion defined by a bend or knee in each element, said grinding device comprising:

individual bristlelike elastic bendable elements mounted on a support so as to extend radially therefrom, said elements having a length and size so as to penetrate between the clothing elements without extending beyond a head portion of the clothing elements; and a drive connected with said element support to rotate said support at a speed and in a linear direction only with respect to movement of the flats such that said bendable elements can sweep over and between free ends of said clothing elements from behind and laterally grind side surfaces of the clothing elements.

2. The grinding apparatus as in claim 1, wherein said apparatus is portable and mountable to different textile machines, said apparatus further comprising a holder supporting said bendable element support and said drive and configured for being removably mountable to a frame component of different textile machines.

3. The grinding apparatus as in claim 1, further comprising a suction device disposed to draw a suction in the vicinity of the point of grinding between said bendable elements and the clothing elements to remove particles resulting from the grinding.

4. The grinding apparatus as in claim 3, wherein said suction device has a wide so as to take a suction over the working width of the set of moving flats.

5. The grinding apparatus as in claim 4, further comprising a suction device disposed to draw a suction in the vicinity of the point of grinding between said bendable elements and the clothing elements to remove particles resulting from the grinding.

6. The grinding apparatus as in claim 5, wherein said suction device has a width so as to take a suction over the working width of the set of moving flats.

7. A grinding apparatus for grinding individual clothing elements of a set of moving flats in a textile machine, the clothing elements having a head portion defined by a bend or knee in each element, said grinding device comprising:

elastic bendable elements mounted on a support, said elements having a length and size so as to penetrate between the clothing elements without extending beyond a head portion of the clothing elements;

a drive connected with said element support to move said support such that said bendable elements can sweep over and between free ends of said clothing elements and laterally grind side surfaces of the clothing elements; and a control system configured to intermittently engage and operate said apparatus during specific time periods of operation of the textile machine.

8. The grinding apparatus as in claim 7, wherein said control system operates said apparatus during said time periods to grind the clothing elements a predetermined number of times during each time period.

9. The grinding apparatus as in claim 7, wherein said apparatus is portable and mountable to different textile machines, said apparatus further comprising a supporting holder configured for being removably mountable to a frame component of different textile machines.

10. A grinding apparatus for grinding individual clothing elements of a set of moving flats in a textile machine, the clothing elements having a head portion defined by a bend or knee in each element, said grinding device comprising:

elastic bendable elements mounted on a support, said elements having a length and size so as to penetrate between the clothing elements without extending beyond a head portion of the clothing elements;

a drive connected with said element support to move said support such that said bendable elements can sweep over and between free ends of said clothing elements and laterally grind side surfaces of the clothing elements; and a shifting device configured at a grinding location where the clothing elements are ground by said elastic bendable elements, said shifting device disposed in the path of travel of the moving flats so as to contact and move the flats towards the elastic bendable elements as they move through said grinding location.

11. The grinding apparatus as in claim 10, wherein said shifting device defines running surfaces over which the flats are conveyed, said running surfaces causing the flats to move towards said elastic bendable elements.

12. The grinding apparatus as in claim 10, wherein said running surfaces are defined on controllably movable lifting elements.

13. The grinding apparatus as in claim 12, wherein said lifting elements are pneumatically operated.

14. The grinding apparatus as in claim 12, wherein said lifting elements are adjustable so as to vary the distance between the clothing elements and said bendable element support.

15. The grinding apparatus as in claim 12, further comprising a stop element disposed to contact and limit the degree of movement of said lifting elements.

16. The grinding apparatus as in claim 15, wherein said stop elements are adjustable to vary the distance between said clothing elements and said bendable element support.

* * * * *